US005380107A

United States Patent [19]

Hiroe et al.

[11] Patent Number: 5,380,107

[45] Date of Patent: Jan. 10, 1995

[54] BASE FABRIC FOR INK RIBBON

[75] Inventors: Nobutake Hiroe, Shiga; Tetsuya Kato, Aichi, both of Japan

[73] Assignee: Toray Industries, Inc., Japan

[21] Appl. No.: 122,464

[22] PCT Filed: Feb. 10, 1993

[86] PCT No.: PCT/JP93/00171

§ 371 Date: Nov. 19, 1993

§ 102(e) Date: Nov. 19, 1993

[87] PCT Pub. No.: WO93/15913

PCT Pub. Date: Aug. 19, 1993

[30] Foreign Application Priority Data

Feb. 13, 1992 [JP] Japan ..... 4-026969

[51] Int. Cl.[6] ..... B41J 31/02; B41J 31/04

[52] U.S. Cl. ..... 400/241; 400/241.3

[58] Field of Search ..... 400/241, 241.1, 241.2, 400/241.3, 241.4

[56] References Cited

U.S. PATENT DOCUMENTS 3,156,338 11/1964 Ploeger, Jr. ..... 400/241.1
4,018,955 4/1977 Klaüke et al. ..... 400/241.2
5,017,029 5/1991 Andou et al. ..... 400/241

*Primary Examiner*—Edgar S. Burr
*Assistant Examiner*—Lynn D. Hendrickson
*Attorney, Agent, or Firm*—Austin R. Miller

[57] ABSTRACT

The present invention relates to a base fabric for an ink ribbon having excellent durability of the welded part of an ink ribbon used an impact printer.

Practically, it is characterized by a constitution wherein at least one yarn of the warp and the weft constituting the base fabric is constituted of a core/sheath-type composite yarn wherein the core is a polyamide polymer and the sheath is a polyamide polymer with a melting point being lower than that of said polyamide polymer.

8 Claims, No Drawings

BASE FABRIC FOR INK RIBBON

TECHNOLOGICAL FIELD

The present invention relates to a base fabric for an ink ribbon which provides an ink ribbon which may be used for an impact-type printer and exhibits excellent durability on the welded part.

TECHNOLOGICAL BACKGROUND

Recently, as an ink ribbon used for an impact-type printer, the conventional spool types have been decreasing in number and products wherein a long tape-like ink ribbon is folded and stored in a cassette have been increasing. However, in such ink ribbons, both ends are welded (adhered) by means of an ultrasonic welder and made into an endless-type product and the life of the welded part exerts an influence upon the life of the ink ribbon. Namely, as the ink ribbon receives impacts from a head pin of a printer during printing and is gradually destroyed, the welded part exhibits lower durability than that of the ordinary part of a base fabric. Especially in these days, with remarkable increase in speeding and impacting of printers, remarkable improvement of durability of the welded part of the ink ribbon has been earnestly desired.

As a means for improving durability of the welded part, a technology wherein a thermoplastic synthetic resin layer with a melting point lower than that of the base fabric was placed between two ink ribbons and was welded, was proposed in Japanese Patent Publication No. 13,431/1982. However, there existed still problems that the improvement of durability of the welded part was not practically sufficient even by this method and workability on welding was not good either. Namely, it is the present status that improvement of durability of the welded part to cope with speeding up and impacting of a printer has not been realized.

DISCLOSURE OF THE PRESENT INVENTION

The present invention provides a base fabric for an ink ribbon with good durability of the welded part. The present invention uses the following means for realizing such a purpose.

Namely, the base fabric for an ink ribbon of the present invention is characterized by a constitution wherein at least one yarn of the warp and weft constituting the base fabric is constituted of core/sheath-type composite fibers wherein the sheath component consists of a polymer with a melting point that is lower than that of the core component. An example of the favorable embodiments is the case wherein the core component of said core/ sheath-type composite fiber is a polyamide polymer and the sheath component is a polyamide polymer with a melting point that is lower than that of said polyamide polymer.

The present invention has a feature wherein a base fabric for an ink ribbon is formed with a fiber having weldability as a single fiber unit. Namely, a base fabric woven by using a core/sheath composite fiber wherein the inner layer (the core) of the single fiber is constituted of a high melting point polymer and the surface layer part (the sheath) is constituted of a low melting point polymer as at least one yarn of the warp and the weft, exhibits extremely high adhesive force by welding and no extreme decrease in strength by welding, and durability of the welded part is remarkably improved.

As the polymer used for the core of the present invention, polyamides and polyesters are representative and especially, as the polyamides, nylon 46, nylon 66, nylon 610, nylon 11 etc., are cited and as polyamides used for the sheath, such a nylon that has a melting point that is lower than that of the core polymer, preferably 10°-120° C. lower and more preferably 20°-100° C. lower among these nylons, for example, a copolymer wherein an amide raw material for tha above described nylon is copolymerized with one or more different kinds of amide raw materials can be used. As the polyesters, polyethylene terephthalate, polybutylene terephthalate or copolymers thereof are used as the core or the sheath components.

The composite ratio of the sheath in the core/sheath composite fiber is preferably 5-90% to the weight of the composite fiber from the viewpoint of improvement of durability of the welded part and more preferably, 10-80%. Beyond the range of 5-90%, the effect for improving durability of the welded part decreases.

The melting point of the sheath compmnent is preferably 10°-120° C. lower than that of the core component from the viewpoint of durability of the welded part and more preferably 20°-100° C. lower. When the difference in melting point is less than 10° C., the effect of durability of the welded part decreases and when the difference exceeds 120, spinnability of the core/sheath composite fiber decreases.

The relative viscosity measured in sulfuric acid of the polymer constituting the core or the sheath component is preferably 2.4-3.8 from the viewpoint of durability of the welded part. In addition, the content of titanium oxide incorporated in the fiber is preferably 0.15% or less but it is not restricted by this limitation.

On the other hand, denier of a warp or a weft is preferably 5-150 denier. In addition, denier of a monofilament constituting such a yarn is preferably 0.6-3.0 denier being generally used for forming a thin base fabric. When the denier of a monofilament is less than 0.6 denier, there exists a tendency that durability of the base fabric part decreases and when the denier of a monofilament exceeds 3.0 denier, clarity of printing tends to become worse.

Both the warp and weft may be non-twisted but additional twisting in the range of 150-700 T/m is preferable and in the range of 200-600 T/m is more preferable from the viewpoint of weaving characteristics.

As a fabric texture for such a base fabric an ink ribbon, plane weave, inductive plane weave, twill weave, satin weave etc., are used but it is not specifically restricted by them.

As the weaving density of such a fabric, the warps are perferably 130-600 yarns/in, more preferably 140-550 yarns/in and the wefts are preferably 100-400 yarns/in, more preferably 110-350 yarns/in.

The base fabric for an ink ribbon thus obtained is usually performed by scouring and finishing set after weaving. Preferably, it is scoured by liquid flow and is set for finishing in the range of 160°-240° C. by means of a pin tenter. Thereafter, said base fabric is adhered (impregnated) with an appropriate amount of an ink material such as a usual oil ink and is welded to form an endless ink ribbon. Welding is usually performed by welding both ends of a base fabric for an ink ribbon by means of an ultrasonic welder.

On the base fabric for an ink ribbon of the present invention, a stable welding can be accomplished in spite of the existence of an oil ink even if welding is performed under a condition wherein the fabric is impregnated with the oil ink as described above. On the contrary, in a method wherein welding is performed by placing low melting point sheet between the welding parts as the conventional technology, there exists a limitation on improvement of durability of the welded part probably because the welded area is not made large enough.

It is a matter of course that the base fabric for an ink ribbon of the present invention can be a product which is treated with an appropriate after-treatment such as high pressure fluid treatment, plasma treatment, surface active agent treatment and resin processing.

THE BEST EMBODIMENT FOR PRACTICING THE PRESENT INVENTION

The present invention will be explained in detail hereinbelow by Examples but interpretation of the present invention is not limited at all by these examples.

(1) The method for evaluation of durability of the welded part of the base fabric in Examples was performed by the following method.

A prepared base fabric for an ink ribbon was cut by fusing into a width of 13 mm and was cut once by scissors into a whole length of 13 m and then, these fabrics were coated with 22 wt. % oil ink (CBK-14 manufactured by Sakata Inks Co., Ltd.) based on the weight of the base fabric and then, were welded by means of an ultrasonic welder (M-8400 manufactured by Branson Co., Ltd.). Seven welded parts were provided in an approximately equal distance in the ink ribbon to prepare an endless ink ribbon.

This ink ribbon was stored in a cassette for a 24 pin dot printer (UP-130K manufactured by Espon Co., Ltd.) and this cassette was set in the above described printer and English letters and numerals were printed and the number of printed letters was read when a pinhole occurred on the welded part and the mean value was made as durability of the welded part of the base fabric.

◎: 1.11 million letters or more
o: 0.91–1.10 million letters
Δ: 0.71–0.90 million letters
x: 0.70 million letters or less

EXAMPLES 1–12 AND COMPARATIVE EXAMPLE 1

Nylon filament yarn each having a melting point shown in Table 1, namely, for a core/sheath-type composite fiber wherein a nylon 66 polymer with a relative viscosity measured in sulfuric acid of 2.85 was used as the core and a nylon 6 polymer with a relative viscosity measured in sulfuric acid of 2.80 was used as the sheath, multifilament yarns each with a polymer weight ratio of the core to the sheath of 9.5/0.5, 9/1, 8/2, 7/3, 6/4, 5/5, 4/6, 3/7, 2/8, or 1/9 and with 40 denier 34 filaments were prepared (Examples 1–10).

In addition, based on a core/sheath-type composite fiber wherein a nylon 66 polymer with a relative viscosity measured in sulfuric acid of 2.85 was used as the core and a nylon 6 polymer with a relative viscosity measured in sulfuric acid of 2.80 was used as the sheath, a multifilament yarn with a polymer weight ratio of the core to the sheath of 50/50 and with 40 denier 24 filaments was prepared (Example 11). In addition, a multifilament yarn with 40 denier 34 filaments which consists of core/sheath-type composite fibers (the weight ratio of the core/the sheath: 50/50) wherein a nylon 66 polymer with a relative viscosity measured in sulfuric acid of 2.85 was used as the core and a copolymer of nylon 6 and nylon 66 with a relative viscosity measured in sulfuric acid of 2.80 (the weght ratio of nylon 6 to nylon 66:85:15 and the melting point: 190° C.) was used as the sheath, was prepared (Example 12).

On the other hand, an ordinary multifilament with 40 denier 34 filaments consisting of only a generally used nylon 66 was prepared (Comparative Example 1).

On these yarns, additional twisting of 280 T/m was performed on each of yarns used for warps of fabrics and yarns with no additional twisting were used as wefts.

Fabrics consisting of a plane texture were prepared by using the warps and the wefts respectively prepared and scouring and finishing set were performed by a usual method to prepare base fabrics for an ink ribbon shown in Table 1. Using these fabrics for an ink ribbon, ink ribbons were prepared based on the above described testing method and durabilities of the welded parts were measured and the results were shown in Table 1.

As clearly seen in Table 1, the samples for Examples 1–12 exhibited good durabilities of the welded parts of the base fabrics.

On the contrary, in Comparative Example 1, durability of the welded part of the base fabric was bad and was not fit for practical use.

TABLE 1

| | Core | | Sheath | | Core/Sheath Component Condition | | | | Durability |
|---|---|---|---|---|---|---|---|---|---|
| | Polymer | Melting Point | Polymer | Melting Point | Difference in Melting Point | Weight Ratio | Weave Density Warp | Weave Density Weft | of Welded Part |
| Example 1 | N66 | 253 | N6 | 217 | 36 | 5/5 | 208 | 124 | Δ |
| Example 2 | " | " | " | " | " | 2/8 | 209 | 123 | Δ |
| Example 3 | " | " | " | " | " | 3/7 | 208 | 125 | o |
| Example 4 | " | " | " | " | " | 4/6 | 206 | 124 | ◎ |
| Example 5 | " | " | " | " | " | 5/5 | 209 | 124 | ◎ |
| Example 6 | " | " | " | " | " | 6/4 | 208 | 123 | ◎ |
| Example 7 | " | " | " | " | " | 7/3 | 207 | 125 | ◎ |
| Example 8 | " | " | " | " | " | 8/2 | 207 | 125 | o |
| Example 9 | " | " | " | " | " | 9/1 | 207 | 123 | Δ |
| Example 10 | " | " | " | " | " | 9.5/0.5 | 207 | 125 | Δ |
| Example 11 | " | " | " | " | " | 5/5 | 207 | 125 | ◎ |
| Example 12 | " | " | N66/N6 | 190 | 63 | 5/5 | 208 | 124 | ◎ |

TABLE 1-continued

| | Core | | Sheath | | Core/Sheath Component Condition | | Weave Density | | Durability of Welded Part |
|---|---|---|---|---|---|---|---|---|---|
| | Polymer | Melting Point | Polymer | Melting Point | Difference in Melting Point | Weight Ratio | Warp | Weft | |
| Comparative Example 1 | N66 | | | | | | 208 | 125 | x |

In the Table
Melting point and difference in melting point: (°C.)
N66 and N6 of polymer: Nylon 66 and Nylon 6
N66/N6 of polymer: a copolymer of Nylon 66/Nylon 6
Weave density: (Yarns/in)
Comparative Example 1: An ordinary multifilament consisting of N66 was used.
Kind of the yarns of the multifilaments used in the above described Examples 1-10 and 12 and Comparative Example: All were 40D-34fil.
Kind of the yarn of the multifilament used in Example 11: All were 40D-24fil.

POSSIBILITY OF INDUSTRIAL APPLICATIONS

As the base fabric for an ink ribbon of the present invention exhibits good durability of the welded part of the base fabric, it can be used as an endless ink ribbon having a welded part among ink ribbons used for various impact printers such as line printers and serial printers. Not only demands for ink ribbons for general impact printers like these can be expected but also a large demands can be especially expected in high speed-type printers, high duty copying-type printers etc., with strong impact.

What is claimed:

1. A base fabric for an ink ribbon comprising woven warp and well yarns wherein at least one yarn of the warp or the weft of the base fabric comprises core/-sheath-type composite fibers wherein the sheath component is a polymer having a melting point that is lower than that of the core component.

2. A base fabric as defined in claim 1 wherein the core component of said core/sheath-type composite fiber is a polyamide and wherein the sheath component is a polyamide having a melting point that is lower than that of said polyamide core component.

3. A base fabric as defined in claim 1 wherein the melting point of said sheath component is 10°-120° C. lower than the melting point of said core component.

4. A base fabric as defined in claim 1 wherein the melting point of said sheath component is 20°-100° C. lower than the melting point of said core component.

5. A base fabric as defined in claim 1 wherein the weight ratio of coresheath is 80/20-10/90.

6. A base fabric as defined in claim 1 wherein said sheath is a copolymer of nylon 66 and nylon 6, and wherein said core component is nylon 66.

7. A base fabric as defined in claim 1 wherein said sheath component is nylon 6 and said core component is nylon 66.

8. A base fabric as defined in claim 1 the ink ribbon is an endless type ink ribbon having a welded part.

* * * * *